US005388340A

United States Patent [19]

Marty

[11] Patent Number: 5,388,340

[45] Date of Patent: Feb. 14, 1995

[54] STAIR LAYOUT SQUARE WITH ADJUSTABLE RAKE BAR

[76] Inventor: Alva R. Marty, 120 County Rd. 1168, Cullman, Ala. 35055

[21] Appl. No.: 29,528

[22] Filed: Mar. 11, 1993

[51] Int. Cl.[6] ..... B43L 7/10; B43L 7/14

[52] U.S. Cl. ..... 33/421; 33/423

[58] Field of Search ..... 33/421, 420, 423

[56] References Cited

U.S. PATENT DOCUMENTS

| | | | |
|---|---|---|---|
| 243,592 | 6/1881 | Marvick | 33/420 |
| 327,283 | 9/1885 | Levy | 33/421 |
| 1,006,815 | 10/1911 | Wiegman | 33/421 |
| 1,050,969 | 1/1913 | McLeod | 33/420 |
| 1,056,917 | 3/1913 | Len | 33/420 |
| 1,187,272 | 6/1916 | Demmrich | 33/421 |
| 1,189,983 | 7/1916 | McLeod | 33/421 |
| 1,237,790 | 8/1917 | Kidder | 33/420 |
| 1,770,304 | 7/1930 | Ferris | 33/421 |
| 3,112,568 | 12/1963 | Baker | 33/421 |

*Primary Examiner*—Christopher W. Fulton
*Attorney, Agent, or Firm*—Joseph H. Beumer

[57] ABSTRACT

A square for laying out and marking run and rise lines on supporting stringers for a staircase has a rake bar connected to slots near the ends of blades of the square. Markings showing a range of horizontal run distances are placed on the outer edge of the long blade of the square, and markings showing vertical rise distances are given on the outer edge of the short blade. The rake bar has a contact surface perpendicular to the plane of the square and has one end alignable with a marking corresponding to a selected run distance and the other end alignable with a rise distance marking. Once aligned, the bar is held in position against the blades by a pair of bolts. Placement of the adjusted tool with the rake bar contact surface flush against a side edge surface of a stringer results in outer edges of the blades being put in positions where horizontal and vertical cuts are to be made in the stringer.

1 Claim, 3 Drawing Sheets

STAIR LAYOUT SQUARE WITH ADJUSTABLE RAKE BAR

FIELD OF THE INVENTION

This invention relates generally to carpentry tools and more particularly to tools for laying out stringers on which stair steps and risers are to be mounted.

BACKGROUND OF THE INVENTION

One of the problems presented in building a staircase is to provide for precise placement of horizontal steps and vertical risers on supporting stringers. This requires making horizontal and vertical cuts in diagonally extending stringers at required locations. Placement of lines on the stringers for making cuts at these locations require determination of vertical rise and horizontal run distances for the particular staircase and inscribing the lines on the stringers with the aid of a suitable square or similar tool placed in a position responsive to rise and run distances.

Conventional framing squares have been used for laying out stringers for stairs. In using such a square, however, the carpenter must hold the framing square on a piece of lumber while lining up the proper numbers on each of the blades with the edge of the board. This operation must be repeated for each step and can be tedious and time consuming as well as highly susceptible to mistakes due to misreading and marking the wrong setting. Thus, a need exists for a specialized square which can be used without making separate readings for each step.

Various types of special templates and squares for laying out stair stringers are disclosed in prior patents. U.S. Pat. No. 4,882,846, issued Nov. 28, 1989, to Reed discloses a stair building template using a plurality of rectangular-shaped horizontal and vertical members held in right-angle relationship. Swanson in U.S. Pat. No. 4,513,510, issued Apr. 30, 1985, discloses a tool having a triangular-shaped flat member with a tee along one edge and a layout bar alignable with slots in a side member. In use this tool is held against the edge of a stringer, and contact is made by stops which make contact over only a small area. A stairs layout tool in which a T-square is mounted on the leg of a conventional framing square is disclosed in U.S. Pat. No. 3,478,434, issued Nov. 18, 1969, to Catalano. Wright in U.S. Pat. No. 4,280,282, issued Jul. 28, 1981, discloses a triangular template with a movable outside portion of one of the legs. Adjustments in the position of the outside portion are made by engaging a selected one of a series of connections and by movement of a pivoting fulcrum. These tools present disadvantages in their complexity and difficulty of use in certain respects. For example, two of the patents require holding the tool, once settings have been made, against a side edge surface of a stringer during scribing, with contact of the tool and stringer being made over only a small area. This results in the tendency of the tool to slip and produce erroneous readings. A tool providing greater contact over an elongated, flush area is needed to avoid this problem. Other desired features include simplicity, ease of use, effectiveness, and a compact size such that a carpenter would be willing to carry the tool around in a toolbox so as to be available when needed.

SUMMARY OF THE INVENTION

The present invention is directed to a stair layout square having two flat planar blades, one long and one short, disposed at right angles to one another and a rake bar movably connected to each of the blades for being positioned at a distal location on one blade corresponding to a predetermined rise distance and at a distal location on the other blade corresponding to a predetermined run distance. The rake bar has a flat contacting surface perpendicular to the plane of the blades and facing toward the intersection of the blades. Upon being secured in position on each blade, the rake bar contact surface is engageable with the side edge surface of a stringer to bring the outer edges of the blades in proper alignment for making rise and run lines on the stringer. Markings may be made successively for each step without taking further readings or readjusting the settings.

This square provides for movement of the rake bar over a range of distance values corresponding to distances desired for staircases, typically a six- to eight-inch rise distance and a ten- to twelve-inch run distance. Movement capability is provided by means of an elongated slot in each blade, parallel to the outer edge of the blade and extending over the selected distance range, with the bar being movably connected to the blade at the slot so as to be movable inward and outward with respect to the blade intersection. The bar also has a slot near each end to enable connecting bolts which ride in slots in the blades to move together and apart upon moving toward and away from the blade intersection. Scale markings along the outer edges of the blades indicate distance locations within the desired ranges.

It is therefore an object of this invention to provide a square for laying out step-supporting stringers wherein contact of a portion of the square engaging the stringer is obtained over a large area.

Another object is to provide a stair layout square that is simple to use and compact in size.

Still another object is to provide a layout square which, once adjusted to reflect predetermined rise and run distances, may then be used for the entire length of a stringer without further adjustments or readings being taken.

Other objects and advantages of the invention will be apparent from the following detailed description.

DESCRIPTION OF THE PREFERRED EMBODIMENT

Figure 1:
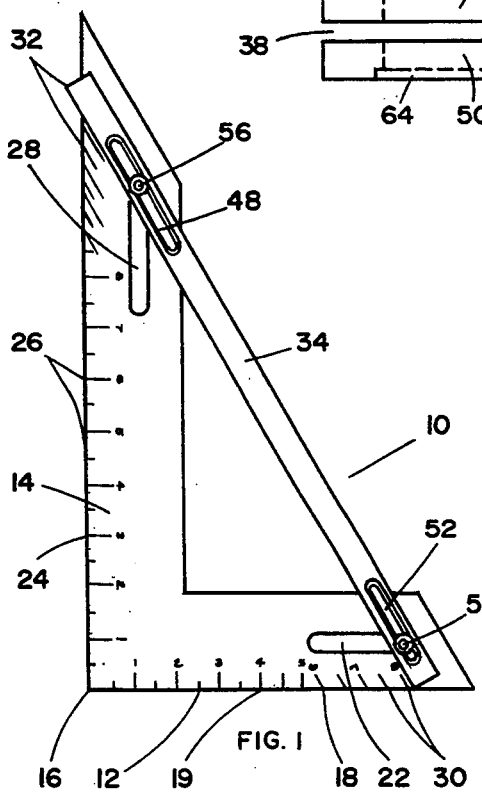
FIG. 1 is a top view of the layout square of the present invention.

Referring to FIG. 1 of the drawings, there is shown a stair layout square tool 10 embodying the invention. The square has a pair of flat blades 12, 14 disposed at right angles and intersecting at a point or corner 16. Short blade 12 has inscribed thereon along outer edge 18 a series of markings 19 showing the distance from corner 16. An elongated slot 22 is provided in blade 12 spaced apart from and parallel to edge 18. The length of the slot defines an operating range of vertical rise distances over which the tool may be adjusted.

Long blade 14 also has a series of markings 26 inscribed adjacent to outer edge 24, the markings showing the distance to corner 16. Elongated slot 28 in blade 14 is provided parallel to edge 24 and spaced apart therefrom the same distance as slot 22 is separated from edge 18. As is the case for slot 22 in blade 12, the length of slot 28 defines a range of distances over which the tool may be adjusted, in this case, the distances corresponding to horizontal run distances.

Markings on the blades within the ranges defined by the slots are in the form of diagonal lines 30, 32 generally parallel to rake bar 34 to enable more precise reading of distance values in adjusting the tool.

Figure 2:
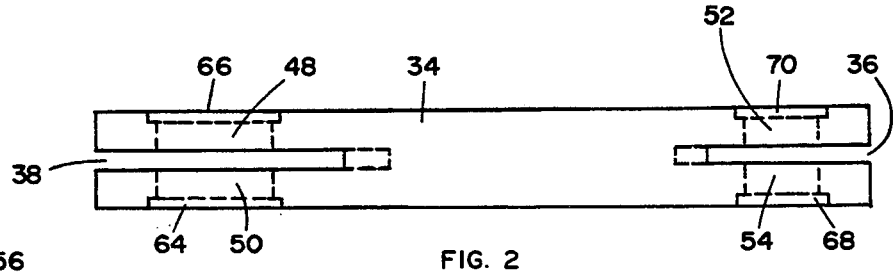
FIG. 2 is a top view of the rake bar of the invention with internal structure shown in dotted lines.

As shown in FIG. 2, rake bar 34 has a generally rectangular shape with notches 36, 38 extending longitudinally from each end over a portion of the bar as required to enable movement over a desired distance range. Notch 36 is sized and arranged to receive blade 12 so that the blade may ride over the bar at the desired distance range, and notch 38 similarly receives blade 14.

Figure 3:
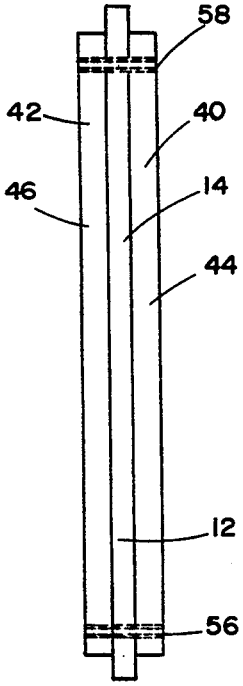
FIG. 3 is an elevational view of the layout square looking toward the contact surface of the rake bar.

Laterally outer portions 40, 42 of the rake bar (FIG. 3) each have a flat surface 44, 46 disposed along the inwardly facing side of the bar, which surface is engageable with a side edge of a stringer after making adjustments for rise and run distances. In the embodiment shown, the bar has an engageable surface on each side of the bar so as to enable the tool to be used with either one of the two faces of the blades placed in sight of the user. The two sides and engageable portions are in effect mirror images of one another and are thus capable of "left-handed" and "right-handed" use, depending on the configuration of a particular staircase.

Figure 4:
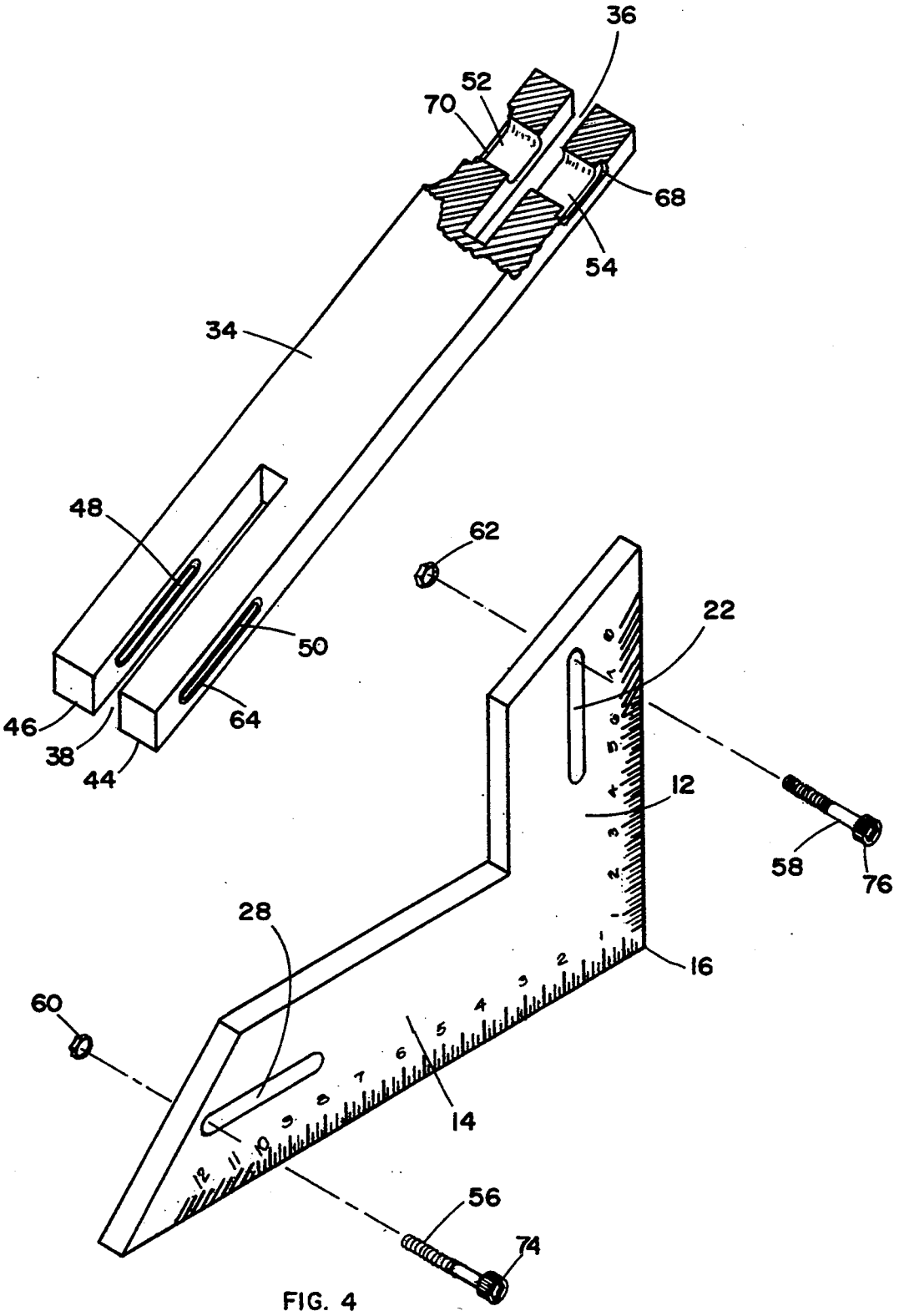
FIG. 4 is an exploded view of the layout square with a portion of the rake bar shown in section.

Bar 34 has a pair of elongated slots 48, 50 and 52, 54 adjacent to each end, the slots extending perpendicular to the plane of the blades and adapted for alignment with slots 28, 22, respectively, in the blades. The pairs of slots in the bar are sized to allow the bar to move freely inwardly and outwardly with respect to the corner 16 over the desired distance ranges. Bar 34 is movably mounted to blades 14, 12 by means of bolts 56, 58 extending through slots 50, 28, 48 and 54, 22, 52, respectively, and engageable with nuts 60, 62 (FIG. 4). The bar is provided with recesses 64, 66 and 68, 70 to receive bolt heads 74, 76 and nuts 60, 62 in a position so as not to project past the side edge surface of the bar. Bolts having a recessed socket head and engageable with an Allen wrench are preferred.

Figures 5, 6:
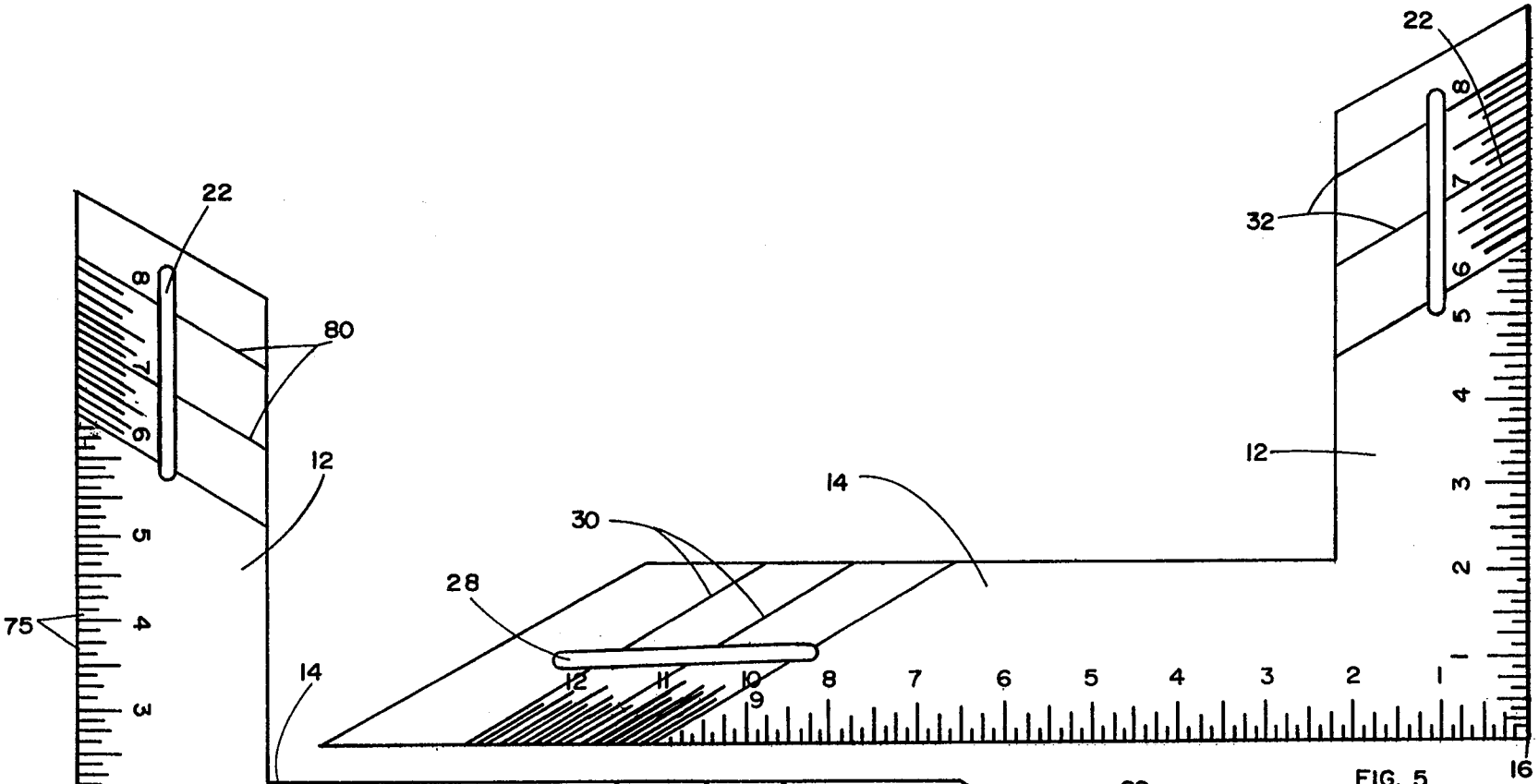
FIG. 5 is a top view of one of the faces of the square.
FIG. 6 is a top view of the opposite face of the square.

FIG. 5 shows more detail of the blades of the square as seen from the same face thereof as is visible in FIG. 1. Note that the diagonal lines 30 extend from 10 to 12 inches on blade 14 across slot 28, defining the available range of run distances, and lines 32 extend from 6 to 8 inches and across slot 32, defining the available range of rise distances.

In FIG. 6, the back face of the square of FIGS. 1, 4, and 5 is shown. Markings 75, 78 and diagonal markings 80, 82 on blades 12 and 14, respectively, are substantially mirror images of those shown in FIG. 5. This allows the tool to be reversed as desired in laying out a given set of stringers.

Although the invention is not to be understood as limited to specific dimensions, the tool of the embodiment described above operates over a range of run distances from 10 to 12 inches, inclusive, and a range of rise distances from 6 to 8 inches, inclusive. The respective ends of the rake bar are adapted to be slid so as to intersect the outer edge of the blades at any point within these ranges. The blades may be two inches wide and have a thickness of 3/16 inch. The blades are preferably made of aluminum by investment casting. The rake bar in this embodiment is 1-½ inches wide and ½ inch thick, with slots and recesses made by machining.

Although the invention is described above in terms of a specific embodiment, it is not to be understood as limited thereto but is limited only as indicated by the appended claims.

I claim:

1. A layout square for determining the location of horizontal run and vertical rise lines on a stair stringer and marking such locations comprising:

an L-shaped square having integral, co-planar blades comprising a long blade having run distances marked on an outer edge thereof and a short blade having rise distances marked on an outer edge thereof;

each of said blades having an elongated slot parallel to a said outer edge, said slots extending along predetermined ranges of run and rise values and ends of said shots defining said ranges;

a rake bar having an elongated contact surface perpendicular to the plane of said blades and engageable with an edge surface of a said stringer, each end of said rake bar being movably connected to a said blade end through a said slot whereby said contacting surface may be aligned with a predetermined run marking and a predetermined rise marking;

markings on said blades showing said rise and run distances and extending diagonally with respect to said outer edges, said markings being disposed generally parallel to said rake bar contact surface;

said run markings being provided at increments within a range of 10 to 12 inches, inclusive, and said rise markings being within a range of 6 to 8 inches, inclusive; and means for securing said rake bar in fixed relation to a said blade upon alignment thereof.

* * * * *